United States Patent [19]

Goldson et al.

[11] Patent Number: 4,776,546

[45] Date of Patent: Oct. 11, 1988

[54] PARENT-CHILD BONDING BIB

[76] Inventors: Alfred L. Goldson; Amy R. Goldson, both of 4015 28th Pl., NW., Washington, D.C. 20008

[21] Appl. No.: 47,101

[22] Filed: May 8, 1987

[51] Int. Cl.[4] ..... A47D 15/00

[52] U.S. Cl. ..... 248/102; 224/148

[58] Field of Search ..... 248/102, 104, 103; 2/75, 49 R; 224/148, 251, 258, 901

[56] References Cited

U.S. PATENT DOCUMENTS

| | | | |
|---|---|---|---|
| 1,987,132 | 1/1935 | Shine | 248/104 |
| 2,494,632 | 1/1950 | Rodin | 224/148 X |
| 2,577,849 | 12/1951 | Henry | 248/102 X |
| 3,065,944 | 11/1962 | Liebendorfer | 224/148 X |
| 3,085,612 | 4/1963 | Gobel | 248/102 UX |
| 4,220,302 | 9/1980 | Hampton | 224/148 X |
| 4,498,613 | 2/1985 | Donahue | 248/102 X |
| 4,537,341 | 8/1985 | Kelly | 224/148 X |

FOREIGN PATENT DOCUMENTS

| | | | |
|---|---|---|---|
| 678702 | 1/1964 | Canada | 248/105 |

OTHER PUBLICATIONS

*The Washington Post,* J. Street, Sep. 27, 1987.

*The Right Start Catalog* p. 14, Spring/Summer 1987.

*Life Span Development,* Martin Blook, New York, MacMillan Pub. 1980, "How Love Begins Between Parent and Child".

*Primary Examiner*—J. Franklin Foss

*Attorney, Agent, or Firm*—Vorys, Sater, Seymour and Pease

[57] ABSTRACT

A bib-like device for assisting in nursing a child and improving bonding between a parent and the child. The device includes a bib-like member made from a fabric, such as terry cloth, comfortable for the child. The device defined includes a generally mammary-shaped area defining a pouch therein for retaining a container of liquid, such as formula, milk, juice, or water for the child. The pouch is sized to receive the container therein and communicates with a opening in the fabric for permitting a nipple on the container to protrude therefrom. When worn by either parent, the device improves bonding between the child and parent, especially for the male, by anatomically simulating the female.

28 Claims, 1 Drawing Sheet

PARENT-CHILD BONDING BIB

BACKGROUND OF THE INVENTION

This invention relates to a device for improving bonding between a parent and a child. More particularly, this invention relates to a bib for either parent having a pouch for holding a container of liquid for the child wherein a nipple on the container protrudes through an opening in the pouch for nursing the child.

Young children, and especially infants, having traditionally supplemented mammary suckling with water or nourishment from a nipple-bearing container. Such nourishment in the earliest period usually comprises a formula which is changed to or supplemented by whole milk and juice when the infant is about six or eight months old. The availability of bottles, caps, and nipples for sterilization by a parent to deliver the formula or milk through the nipple from the bottle is well known. Usually, a parent cradles an infant in one arm while holding the bottle in the other hand so that fluid, such as water, formula, or milk, is provided from the bottle through the nipple to the child. Such a traditional practice has not readily been accompanied by the use of a device to free the bottle-holding hand of the parent.

While maternal parents had in the past borne the major burden for care and feeding of infants, recently male parents have assumed a greater share of that function, for a number of reasons. Studies have shown the positive influence of bonding between parent and child which occurs as a result of the holding and feeding functions. Such studies have confirmed that bonding is improved between the male parent and the infant if the male parent participates more significantly in the nursing procedures. Moreover, even for non-nursing mothers, it has been important to create the bonding contact between parent and child by holding the child during bottle-nursing.

However, it is a shortcoming in the art that few devices are available to both parents to facilitate such nursing and its resulting bonding. Certainly, nursing brassieres are available for the convenience of the mother to nurse a child. However, the art has not developed significantly in providing devices intended for use by the male parent to assist in the nursing function, or other devices for use by the female parent to free the bottleholding hand, while maintaining bonding contact between a parent and the child.

Accordingly, it is a general object of this invention to provide a device for aiding bonding contact between a parent and the infant while nursing.

It is another object to this invention to provide a bib-like fabric device which anatomically stimulates the female anatomy to be worn as a bib by the male parent.

It is an additional object of this invention to provide a device for assisting either parent in nursing a child which holds the bottle in a way which frees both hands of the parent to support and caress the child.

It is still another object of this invention to provide such a device with novelty features to encourage its use by both parents.

It is another object of this invention to provide a nursing aid which may also function as a tote for carrying nursing paraphernalia.

It is still another object of this invention to provide a method for nursing a child which is convenient yet maintains or improves bonding contact between parents and a child, and especially between a male parent and a child.

These and other objects of this invention will become apparent from a detailed description of the invention which follows taken in conjunction with accompanying drawings.

DETAILED DESCRIPTION OF THE PREFERRED EMBODIMENT

Figure 1:
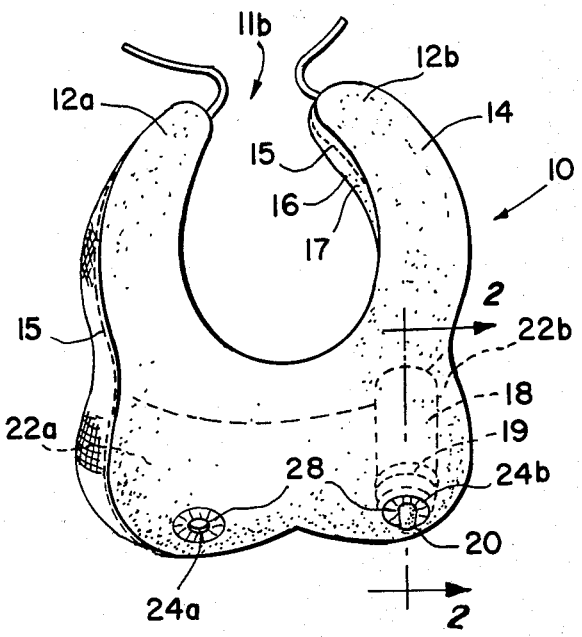
FIG. 1 is a perspective top view of a nursing bib according to the invention.

FIG. 1 is a perspective top view of a nursing bib according to the invention, which is designated generally by the reference numeral 10. The bib 10 includes a body portion 11 terminating at its rearward end portion **11*b* in a pair of extending members 12*a* and 12*b* which are secured at the nape of the neck of its wearer. When so positioned, the bib 10** rests on the chest portion of its user and, as such, is particularly adapted for use by either parent, but especially the male member.

Figure 2:
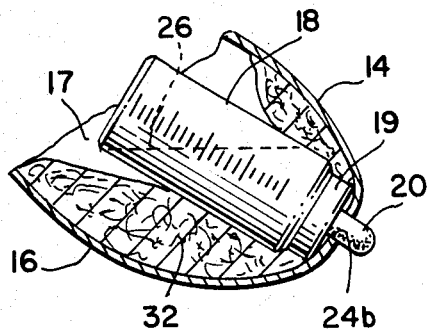
FIG. 2 is a partial sectional view taken along line 2—2 of FIG. 1.
Figure 3:
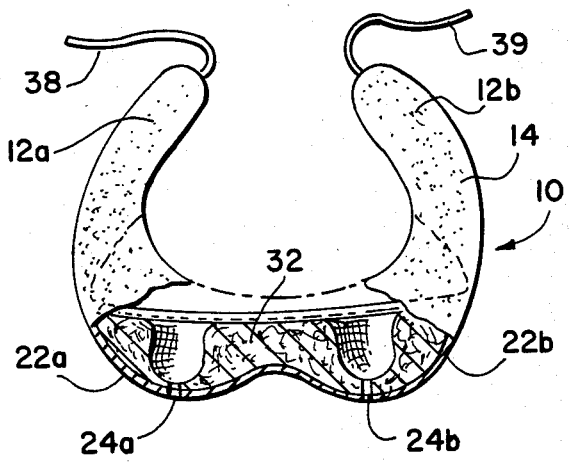
FIG. 3 is a top cutaway view showing the device of FIG. 1 and the pouches therein for receiving nippled bottles.

The bib 10 is preferably made from an upper fabric member 14 stitched along a stitching line 15 to a lower member 16 to form an interior space 17. Both the upper member 14 and the lower member 16 are preferably made from cloth for the convenience of the user, and the upper member 14 is preferably made from a cloth which is comfortable and familiar to the infant, such as terry cloth. The bib 10 shown in FIG. 1 functions as a device for assisting the nursing of an infant by containing, as best seen in FIG. 2, a bottle 18 having a cap 19 terminating in a nipple 20 within a pouch 22 defined by the interior 17 of the bib 10. Preferably, a pair of such pouches **22*a* and 22*b* are formed in the bib 10, which will be sometimes referred to herein as a "bonder", so that its function of improving bonding between a parent and child is respected. As indicated, the bonder 10** is preferably worn by the male parent but also may be utilized by the female parent because of its convenience.

Each of the pouches **22*a* and 22*b* terminates at the forward portion 11*b* of the bonder 10. An opening 24*a*, 24*b* communicates between the exterior of the bib 11 and each pouch 22*a*, 22*b* and is sized to permit a nipple to extend therethrough when a bottle 18 is secured in either pouch 22*a*, 22*b*. A bottle 18, a cap 19, and a nipple 20 are appropriately sterilized and a suitable fluid, such as, water, formula, juice, or milk is placed in the bottle and secured therein by the nipple 20 and the cap 19. As needed, the temperature of the liquid 26 may be adjusted as suitable for nursing a baby. The closed, sterilized bottle 18 is then manually inserted from the rearward end portion 11*b* into a sized pouch 22*a*, 22*b* in the interior space 17 so that the nipple 20 protrudes from the opening 24*a*, 24*b*. The device is then placed on the chest of its user, and the aft-extending portions 12*a* and 12*b* tied to free both hands of its user for caressing, holding, or supporting the nursing child. Thereafter, the child nurses on the bottle contained within the bonder 10** in a fashion which simulates actual nursing.

Preferably, the area 28 about the opening 24 is brightly colored not only to simulate anatomically the presence of the areola but also to attract and maintain the attention of the nursing child. The device may be provided in any suitable contrasting color, such as white, and the area 28 may be colored with a rainbow pattern.

Figure 4:
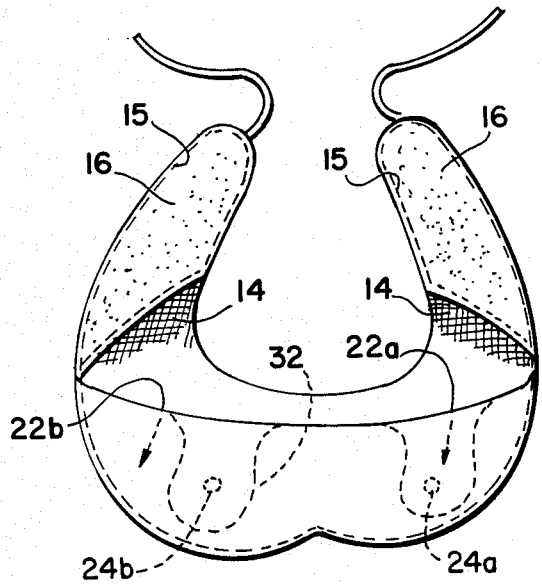
FIG. 4 is a rear-interior view of the device of FIG. 1 showing its interior stuffing for shaping the device for anatomical simulation.

The bonder 10 is given its quasi-anatomically-true shape by the presence of suitable stuffing 32 located intermediate the upper member 14 and lower member 16 within the interior 17 of the bonder 10. As best seen in FIG. 4, the stitching line 15 intermediate the aft-extending members 12A and 12B is not sewn completely closed so that the user has ready access to either pouch **22*a*, 22*b* as well as to insert and remove of the stuffing 32 so that the fabric upper members 14 and 16 may be easily laundered. The interior stuffing 32 may take a variety of shapes and forms so long as the pouches 22 are defined in the interior of the bonder 10 in a way which accommodates a bottle 18** of suitable size.

On occasion, the parent interested in bonding may prefer to utilize merely a pacifier having a nipple 20 so that the infant may suckle on the pacifier as is currently known. In that case, a pacifier is inserted into a pouch 22 so that the nipple of the pacifier protrudes from an opening 24.

The device is useful, not only for the male parent, but for the non-nursing female parent who cannot nurse for typical reasons, such as the injection of medication antithetical to the well-being of the baby.

Figure 5:
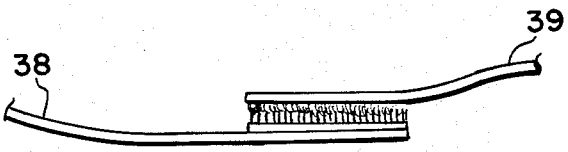
FIG. 5 is an alternative fastener for securing the bib about the neck of its user.

In FIG. 4, ribbon-like structures 38 and 39 are secured to the portions **12*a* and 12*b* of the bonder 10 to facilitate tying about the neck of its user. Such fasteners may take other forms, such as clips, buttons, and other tieback devices, among which is a VELCRO brand fastener as shown diagrammatically in FIG. 5. The fastener of FIG. 5 has the convenience and advantages in securing the members 38 and 39** which are inherent in the use of such VELCRO brand fasteners.

When made of a suitable attractive outer member 14, such as white terry cloth, highly colored in the areola area 24 as described above, the device has a novelty characteristic as well. Moreover, it acts because of the small size of the nipple opening as a attractive tote bag or carrier for nursing paraphernalia within the pouches intended for use during nursing for housing the bottle 18. Thus, the device has a tote characteristic, wholly aside from its nursing and bonding functions. When so used, the members 38 and 39 are secured to act as handles for the tote bag, or for hanging the device 10 on a suitable fastener.

It will clearly be understood by those skilled in the art that the foregoing description has been made in terms of the preferred embodiments and various changes and modifications may be made without departing from the scope of the present invention which is to be defined by the appended claims.

What is claimed:

1. A device for assisting in nursing a child, comprising:

a bib-like structure made from a fabric and structurally adapted to be secured on a person and defining an interior and, in said interior, at least one pouch structurally adapted to receive a member having a nipple for suckling said child, said bib-like structure including a body portion having a height and a width and defining an opening communicating with said pouch from the exterior of such structure to the interior thereof, the axis of said opening being generally transverse to said height and width, so that said nipple protrudes through said opening for suckling said child, whereby infant-adult bonding is promoted.

2. The device as set forth in claim 1, wherein said pouch is structurally adapted to receive a container of liquid for said infant, said container having means for dispensing said liquid through said nipple to said infant.

3. The device as set forth in claim 2, wherein a pair of pouches are provided in the interior of said bib-like structure, each of which is structurally adapted to receive a container of liquid for said infant with means for dispensing said liquid nourishment from a nipple, each of said pouches defining an opening communicating with said pouch and the exterior of said structure so that said nipple on said container can protrude through either of said openings for nursing said infant.

4. The device as set forth in claim 1, wherein said bib-like structure anatomically structurally simulates in part mammaries of an adult.

5. The device as set forth in claim 4, wherein said structure defines about said opening an area of color contrasting with said fabric to simulate an areola and to catch attention of the child.

6. The device as set forth in claim 1, wherein said structure comprises an upper member and a lower member sewn about a significant portion of their joinder to define an interior space therebetween, a portion of said structure being left unsewn to provide access to the interior of said structure thus defined for insertion of said nippled member.

7. The device as set forth in claim 6, further including stuffing within the interior of said bib-like structure for shaping said structure and defining said pouch.

8. The device as set forth in claim 1, wherein said nippled device is an infant pacifier.

9. The device as set forth in claim 1, wherein at least some of said fabric lying outwardly of said bib-like structure is terry cloth.

10. A device for assisting the nursing of an infant, comprising:

a container having a nipple for suckling said infant;

a bib-like member made from a fabric comfortable for said infant, said bib-like member including a body portion having a height and a width and defining a pouch within said member for retaining said nippled container, said pouch being sized to receive said nippled container therein and communicating with an opening in said fabric permitting said nipple on said container to protrude through said opening, the axis of said opening being generally transverse to said height and width, said bib-like member having means for securing said bib-like member about the neck of its user.

11. The device as set forth in claim 10, wherein said pouch is structurally adapted to receive a container of liquid for said infant, said container having means for dispensing said liquid through said nipple to said infant.

12. The device as set forth in claim 11, wherein a pair of pouches are provided at the interior of said bib-like member, each of which is structurally adapted to receive a container of liquid for said infant with means for dispensing said liquid nourishment from a nipple, each of said pouches defining a said opening communicating with said pouch and the exterior of said member so that said nipple on said container protrudes through either of said openings for nursing said infant.

13. The device as set forth in claim 10, wherein said bib-like member anatomically structurally simulates in part mammaries of an adult.

14. The device as set forth in claim 13, wherein said structure defines about said opening an area of color contrasting with said fabric to simulate an areola and to catch attention of the child.

15. The device as set forth in claim 10, wherein said bib-like member comprises an upper member and a lower member sewn about a significant portion of their joinder to define an interior space therebetween, a portion of said structure being left unsewn to provide access to the interior of said structure thus defined for insertion of said nippled container.

16. The device as set forth in claim 15, further including stuffing within the interior of said bib-like member for shaping said member and defining said pouch.

17. The device as set forth in claim 10, wherein said nippled container is an infant pacifier.

18. The device as set forth in claim 10, wherein at least some of said fabric lying outwardly of said bib-like member is terry cloth.

19. A device for assisting in nursing a child, comprising:

a bib made from fabric and adapted to be secured on a person, said bib having a first panel and a second panel secured to said first panel to define a bib interior between said panels, at least one pouch defined in the interior of said bib, said pouch having a first end defining a first opening located within said interior of said bib and a second end opposite to said first end, a second opening through said bib at said second end of said pouch to place said pouch in communication with the exterior of said bib, said second opening being smaller than said first opening, whereby said pouch is adapted to receive a member having a nipple such that the nipple protrudes through said second opening for suckling the child to promote infant-adult bonding.

20. The device of claim 19, wherein the bib has two said pouches and a second opening through said bib at said second end of each of said pouches.

21. The device of claim 19, wherein the bib includes about said second opening an area having a color contrasting with said fabric to simulate a mammarial areola.

22. The device of claim 19, wherein said second panel is sewn to said first panel, an opening being provided between said first and second panels to provide access to the interior of said bib.

23. The device of claim 19, wherein a portion of the bib has the shape of a pair of adult human breasts.

24. The device of claim 23, wherein the bib includes stuffing in said interior to provide said shape.

25. The device of claim 23, wherein said bib includes means for securing the bib on the person such that the bib rests on the chest of the person.

26. The device of claim 19, wherein at least a portion of said fabric is terry cloth.

27. The device of claim 19, wherein the bib includes a body portion defined by said first and second panels, two elongate portions of reduced area extending from said body portion, and a third opening in said body portion to provide access to said interior of said bib, whereby said bib defines a tote bag and the elongate portions act as handles for the tote bag.

28. The device of claim 27, wherein said third opening is between said two elongate portions.

* * * * *